United States Patent [19]

Weinar

[11] 4,115,970

[45] Sep. 26, 1978

[54] GRID CEILING TRIM INTERSECTION CAP

[75] Inventor: Roger Neil Weinar, Buffalo, N.Y.

[73] Assignee: Ceiling Resurfacing Systems, Inc., Eggertsville, N.Y.

[21] Appl. No.: 829,729

[22] Filed: Sep. 1, 1977

[51] Int. Cl.[2] ..... B44F 7/00

[52] U.S. Cl. ..... 52/311; 52/666; 52/750; 403/347; 403/230

[58] Field of Search ..... 403/346, 347, 230, 237, 403/291, 293, 404, 406, 169–178; 52/127, 232, 287, 311, 312, 417, 461, 465, 466, 469, 573, 665, 666, 731, 716–718

[56] References Cited

U.S. PATENT DOCUMENTS

| | | | |
|---|---|---|---|
| 756,861 | 4/1904 | Layton | 403/346 X |
| 2,860,742 | 11/1958 | Waters | 403/404 |
| 3,004,639 | 10/1961 | Choppa | 403/173 |
| 3,119,475 | 1/1964 | Adams | 52/232 |
| 3,343,309 | 9/1967 | Netz et al. | 403/230 X |
| 3,855,747 | 12/1974 | Langan | 52/404 |
| 4,055,930 | 11/1977 | Weinar | 52/717 |

*Primary Examiner*—Wayne L. Shedd
*Attorney, Agent, or Firm*—Raymond F. Kramer

[57] ABSTRACT

An intersection cap for covering the ends of a plurality of pieces of grid celing trim mounted on grid ceiling supports where such supports intersect, usually at right angles, includes a base member, usually cruciform in shape, but sometimes readily convertible to T-shape, for covering the horizontal surfaces of the trim and of any exposed support, wall members extending upwardly from the base member, for covering the sides of the trim and of any exposed support and opposed retainers located at tapered portions of the walls at the ends thereof and beyond the base member which readily, yet firmly, snap fasten onto the trim. Also described is the injection molding of such intersection caps in which the mold parts are moved together in simple linear relative motion to obviate the employment of complex mold part motions to form suitable retainers integral with the walls of the intersection cap.

8 Claims, 8 Drawing Figures

Fig. 1
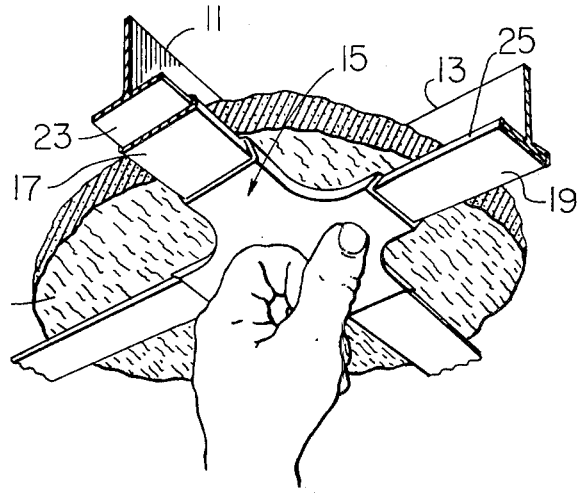
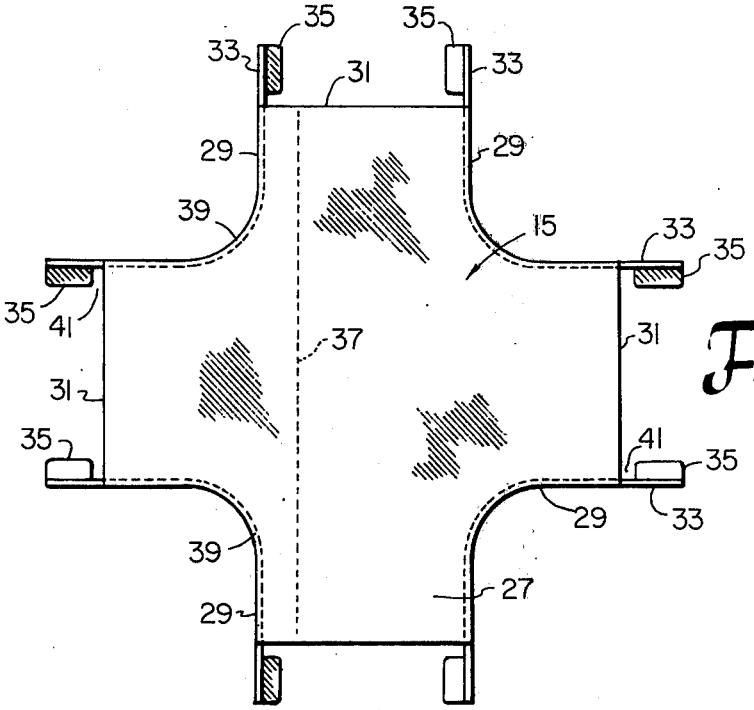
Fig. 2
Fig. 3
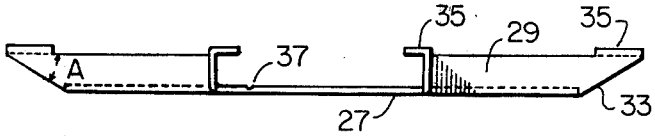
Fig. 4
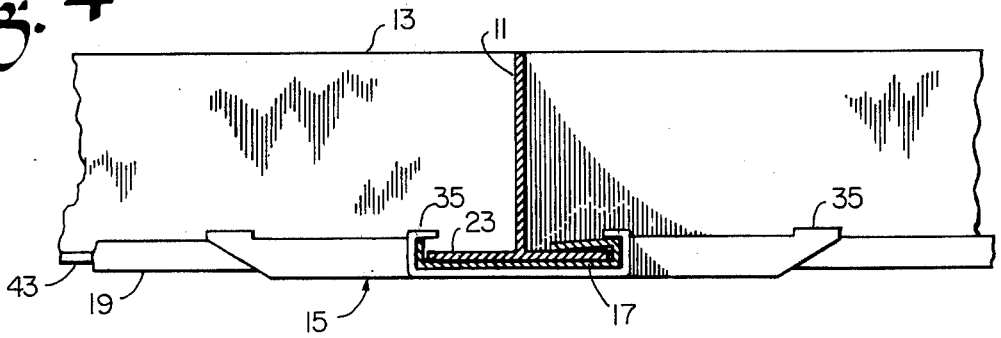

GRID CEILING TRIM INTERSECTION CAP

This invention relates to an intersection cap for covering exposed ends of pieces of grid ceiling trim installed on grid ceiling supports and any parts of the supports which may be visible at intersections thereof. More particularly, it relates to a novel intersection cap construction which, by virtue of the use of retainer tabs which are integral with the cap wall members at the cap ends and which are particularly structurally located at such ends may be readily snap fitted into place by an installer and yet, as proven by experimental testing, retain their desired positions indefinitely. The invention also relates to a simple injection molding technique for producing the invented intersection caps.

Grid ceilings, in which inverted T-shaped supporting members have flanges thereof holding light weight ceiling panels, have been used to a very great extent in modern ceiling construction, both for commercial and residential installations. Such installations have also employed L-shaped supports which have been attached to the walls of the room. Such constructions have been utilized to lower ceilings in older buildings both for modernization and for heating energy conservation. When initially installed the exposed flange portions of the T-members (or L-members) are painted and form attractive dividers between the various ceiling panels. However, especially when subjected to high humidity, as in bathrooms, shower rooms, kitchens and basements and/or grease, as in kitchens, the T-members, which are usually metallic for strength, may rust, become grease and dirt covered or may otherwise become unattractive. In the past such a condition would be corrected by removing the panels, cleaning the exposed supporting surfaces and sometimes, repainting them but such procedures involve inconvenience, loss of use of the facilities, even if only temporary, and expense and there is always the prospect that the operation might have to be repeated shortly after. Accordingly, trims have been designed for installation onto the original T-members without any preliminary preparation of such members. In U.S. Pat. No. 4,055,930 issued Nov. 1, 1977 to Roger Neil Weinar, the present inventor, and John Anthony Eder for Grid Ceiling Trim (on application Ser. No. 690,609, filed May 27, 1976) there are described improved grid ceiling trims which may be made from a minimum of material and which easily and firmly are fastened into place. Also described in that patent are intersection caps suitable for installation over the grid ceiling trim strips where these converge or join at support intersections. Although the intersection caps illustrated in the patent are useful they are not nearly as easily installable as the present caps and require much more complex molding equipment for their production. Accordingly, the present invention is of a significant improvement in the art and makes readily available an inexpensive, light weight, attractive, easily manufactured, readily installable and permanently retained (unless intentionally removed) intersection cap which covers and conceals any unsightly joints near the intersection.

In accordance with the invention an intersection cap for covering ends of a plurality of pieces of grid ceiling trim mounted on grid ceiling supports where such intersect comprises a substantially horizontal base member and a plurality of wall members extending upwardly from the base member, said wall members being tapered upwardly at ends thereof with such tapered portions extending the wall members past the base member, and having at said extended tapered ends inwardly extending retainers suitable for holding onto grid ceiling trim. In preferred embodiments of the invention the taper of the wall members is at an angle under 45° and preferably under 40°, e.g., 35°, the retainers are integrally molded tabs on the tops of the wall end extending inwardly distances greater than the thickness of the grid ceiling trim and the cap is cruciform and includes scoring to make it readily convertible to T-shape for installation adjacent a room wall. Also within the invention is a simple method of injection molding the present intersection cap, which method was not applicable to molding of the cap illustrated in U.S. Pat. No. 4,055,930 (corresponding to Ser. No. 690,609).

The invention and its various advantages will be readily evident from the following description, taken in conjunction with the drawing in which:

FIG. 1 is perspective view, partially broken away at various locations to show structure more clearly, of a cruciform grid ceiling trim intersection cap of this invention being installed;

FIG. 2 is a bottom plan view of the invented cruciform intersection cap (viewed from below when installed);

FIG. 3 is a side elevational view of said cap;

FIG. 4 is a vertical elevation of the cap of FIG. 3 installed on the grid ceiling trim, showing such trim and the grid ceiling support in vertical section;

Figure 5:
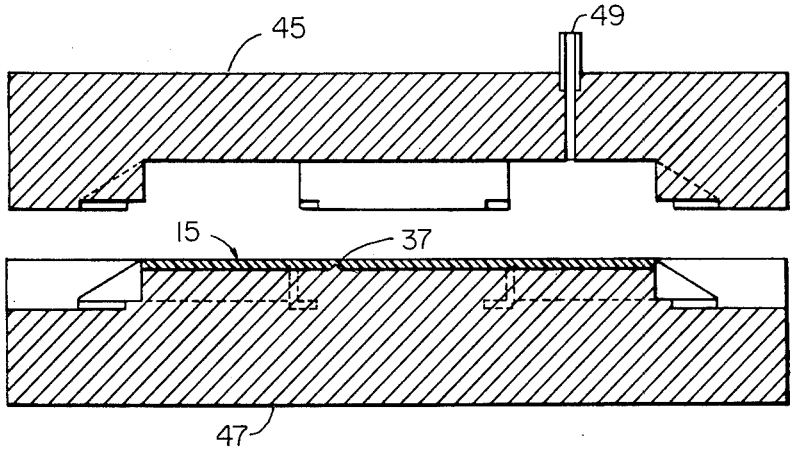
FIG. 5 is a vertical sectional elevation of an injection mold for making the intersection caps of FIGS. 1–4.

In FIG. 1 T-shaped ceiling grid supporting members 11 and 13, which intersect above intersection cap 15, are shown with longitudinally extending grid ceiling trims 17 and 19 installed thereon respectively. Ceiling panels, such as that identified by numeral 21, rest on the trim strips and on the tabs (not shown in this figure) of intersection cap 15. Trim strip 17 is held firmly in place on horizontal flange 23 of T-member support 11 by frictional engagement therewith and by limitation of the transverse movement of the strip by a side wall thereof, corresponding to wall 25 of strip 19. As is seen from the figure it is a simple matter merely to press the intersection cap upwardly into position, during which action the tabs or retainers, to be described in detail later, and the tapered wall extensions to which they are joined spread apart to facilitate placing of the cap against the trim strips and then resiliently return to original position to hold the cap in place.

In FIG. 2 intersection cap 15 is shown to include a horizontal base member 27, which is substantially flat (often preferably flat) and serves to conceal the intersections of the trim and the ceiling grid supporting members, walls 29, extending upwardly from the base member (directions are utilized with respect to the installed position of the intersection cap, for clarity of understanding), which walls are tapered upwardly from ends 31 of the intersection cap, as shown at 33 (more clearly seen in FIG. 3) and inwardly extending retainers 35, being shown as tab-shaped, suitable, in pairs, for holding onto the grid ceiling trim. As illustrated in FIG.

2 the intersection cap is cruciform, suitable for installation at a right angled intersection of grid ceiling trim strips on a ceiling section away from the walls but score line or weakening channel 37 is provided for readily dividing the cap and forming from it (the right hand side portion) a cap suitable for installation at the sides of the ceiling near the walls, with line 37 being adjacent such a wall. Dividing line or groove 37 is more clearly shown in FIG. 3, as are the tapered portions 33 of wall members 29. Note that the wall members are shown to have curved connecting or internal corner sections 39 but it is also within the invention to make these straight walled, so that they meet at an angle, preferably at a right angle. Although the intersection illustrated in FIG. 2 is the most common, a right angled intersection of the ceiling grid support and trim members, it is within the invention to utilize other angles of intersection and to have different numbers than four, e.g., three, six, pieces of trim onto which the intersection cap fits.

In FIG. 3 it will be noted that the angle of taper of the tapered ends of the intersection cap, is an acute angle, less than 45° and preferably less than 40°, being shown here as about 35°. Such angle is desirable in the present construction to allow better resiliency of the integrally molded synthetic organic polymeric plastic intersection cap and the angle and the location of the tabs beyond the end 31 of base 27 facilitates ready movement of wall portion 33 outwardly, away from an opposing such wall portion when the intersection cap is being installed and helps to permit bending of the wall as tabs 35 are moved downwardly (relatively speaking) when the cap is installed on the trim. See FIG. 2 where clearance 41 is clearly shown between the end 31 of base 27 and tabs 35. The retainers extend inwardly distances sufficient to overlie the trim walls and yet preferably, such distances will be less than the cap wall height so that the retainers will not be pressed against the upper part of the base during installation, which could prevent their fitting about the trim strip.

In FIG. 4 there is illustrated the fitting of intersection cap 15 over trim strips 17 and 19, held respectively on flanges 23 and 43 of T-shaped supporting members 11 and 13. FIG. 4 illustrates well how retainer tabs 35 hold onto the uppermost surfaces of the grid trim.

In addition to the present construction facilitating easy installation of the intersection cap, it allows ready removal thereof when such is desirable, so that the cap need not be destroyed but is capable of reuse on other installations. In addition to such desirable features the present construction permits the simple molding, as by injection molding, of the intersection cap with the mold parts moving relatively in a straight line. Thus, no complex movements of multiple mold parts are necessary for easy, simple and relatively inexpensive molding of the present articles. In FIG. 5 there is graphically illustrated a simple mold for the manufacture of the present caps. Upper (male) section 45 moves downwardly against lower (female) mold section 47 to form the intersection cap (a completed cap 15 is shown in the mold). In actual operation the mold is closed, liquid plastic is injected through port 49, the mold is cooled, by cooling means, not shown, the mold is opened and the molded part is ejected. As is evident, the result is an integral molded item which is readily and speedily manufactured with simple straight relative motion of the male and female mold parts. It will be appreciated that for the molding of an intersection cap such as that shown in U.S. Pat. No. 4,055,930 (Ser. No. 690,609) a much more complex mold is needed. Also, although a flat surfaced intersection cap is made and illustrated herein it is within the invention to mold it in any shape or surface, e.g., with surface designs, grooves, patterns.

Figure 6:
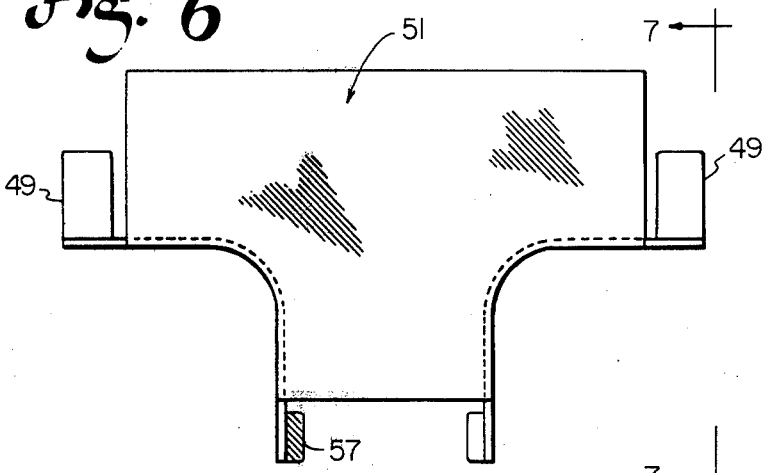
FIG. 6 is a bottom plan view of a T-shaped intersection cap for installation on a ceiling adjacent a wall.
Figure 7:
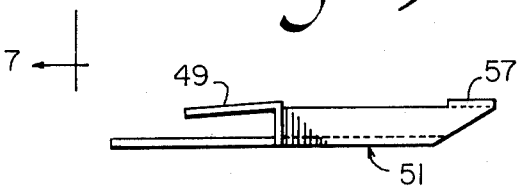
FIG. 7 is an end elevation of the cap of FIG. 6.
Figure 8:
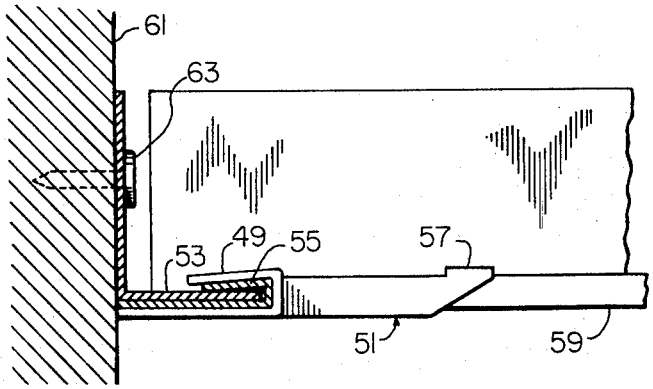
FIG. 8 is an end elevation of the cap of FIG. 7, installed on grid ceiling trim adjacent to a wall, showing in section such trim, an L-shaped grid support for the trim and the wall to which such support is fastened.

In FIGS. 6–8 there is shown a modification of the T-shaped intersection cap formable from the cruciform cap of FIG. 2 by division along parting line 37. In this modification the principal difference is in the retainer tabs 49 being larger so as to make them better capable of holding cap 51 in place. This construction is desirable because of the absence of opposing tabs to assist tabs 49 in holding the cap to the L-shaped supporting member 53 and covering trim 55 (shown in FIG. 8). Thus, tabs 57 hold onto trim 59 in the usual manner but enlarged retainers 49, having larger supporting surfaces, are better held to the trim and corresponding support near the room wall. In FIG. 8 joinder of the L-shaped support 53 to wall 61 by fastening means (nail) 63 is illustrated.

In FIGS. 2–4 tabs 35 extend substantially parallel to base 37, which is substantially horizontal. In FIGS. 7 and 8 retainer 49 is shown to extend downwardly so as better to grip the trim strip. It is within this invention to utilize both such constructions for both such types of retainers, with the downward angle usually being from 5° to 25°, if employed. Also, it is within the invention to offset the various retainers for molding and installation ease, if desired.

Usually the present intersection caps will be made of synthetic organic polymeric plastic, such as any of the commercially available resilient plastics, e.g., polyethylene, polypropylene, injection moldable polyvinyl chloride, engineering plastics (polyacetals), nylons, hard rubbers, acrylonitrile-butadiene-styrene rubbers, polymethyl methacrylate, polystyrene and cellulose acetate. Of such polymers the employment of polyethylene, polypropylene and polyvinyl chloride is preferred and for greater fire retardancy the polyvinyl chloride is most preferred, as is manufacture by the simple injection molding technique described. However, the present caps may also be made of metal, e.g., formable steel sheet, and other suitable materials. Also, the caps may be used on the supports directly, without the covering trim strips.

The invention has been described with respect to various illustrations and embodiments thereof but is not to be limited to these because one of skill in the art with the present specification before him will be able to utilize substitutes and equivalents without departing from the scope of the invention.

What is claimed is:

1. An intersection cap for covering ends of a plurality of pieces of grid ceiling trim mounted on grid ceiling supports where such intersect which comprises a substantially horizontal base member and a plurality of wall members extending upwardly from the base member, said wall members being tapered upwardly away from the base member at ends of the wall members and having at said extended tapered ends inwardly extending retainers suitable for holding onto grid ceiling trim.

2. An intersection cap according to claim 1 which is of integral construction and wherein the base member is substantially flat, the plurality of wall members extend substantially at right angles to the base member, the tapers at the ends of the wall members are of substantially the same angle and make an angle of less than 45° with respect to an extended plane of the base member and the retainers are located past the base member ends and in opposing relationship and extend inwardly distances greater than the thickness of the grid ceiling trim.

3. An intersection cap according to claim 2 which is made of a synthetic organic polymeric plastic of sufficient resilience so that it snaps into place on the grid ceiling trim in such manner that matching retainers are moved toward the base and outwardly as the intersection cap is moved into place on the trim and return to original and retaining position when the intersection cap is in place.

4. An intersection cap according to claim 3 wherein the base is cruciform or T-shaped, the retainers extend inwardly distances less than the cap wall height and the tapers at the ends of the wall members are of angles less than 40°.

5. An intersection cap according to claim 4 in which the base is cruciform in shape with curved internal corners.

6. An intersection cap according to claim 1 wherein the base is cruciform and is weakened along a line extending longitudinally with respect to the grid ceiling support and grid ceiling trim on which it is to be mounted so that upon separating the intersection cap into two parts along said line there is produced from the cruciform cap a T-shaped cap suitable for installation along room walls.

7. An intersection cap according to claim 5 wherein the base is weakened along a line extending longitudinally with respect to the grid ceiling support and grid ceiling trim on which it is to be mounted so that upon separating the intersection cap into two parts along said line there is produced from the cruciform cap a T-shaped cap suitable for installation along room walls.

8. An intersection cap according to claim 7 wherein the scoring or weakening is of an upper surface of the intersection cap and is molded therein.

* * * * *